US006439571B1

(12) United States Patent
Wilson

(10) Patent No.: US 6,439,571 B1
(45) Date of Patent: Aug. 27, 2002

(54) PUZZLE

(76) Inventor: Juan Wilson, 6680 Wiltsie Rd., Panama, NY (US) 14767-9733

( * ) Notice: Subject to any disclaimer, the term of this patent is extended or adjusted under 35 U.S.C. 154(b) by 0 days.

(21) Appl. No.: 09/721,855

(22) Filed: Nov. 21, 2000

Related U.S. Application Data

(60) Provisional application No. 60/167,570, filed on Nov. 26, 1999.

(51) Int. Cl.[7] ..... A63F 9/12

(52) U.S. Cl. ..... 273/157 R; 273/156; 273/161; 446/125

(58) Field of Search ..... 673/157 R, 156, 673/161; 446/92, 124, 125

(56) References Cited

U.S. PATENT DOCUMENTS

| | | | | |
|---|---|---|---|---|
| 2,570,625 A | | 10/1951 | Zimmerman et al. | |
| 2,839,841 A | | 6/1958 | Berry | |
| 3,196,579 A | * | 7/1965 | Lepper | 446/92 |
| 3,254,440 A | * | 6/1966 | Duggar | 446/92 |
| 4,133,152 A | | 1/1979 | Penrose | 52/105 |
| 4,223,890 A | | 9/1980 | Schoen | |
| 4,258,479 A | | 3/1981 | Roane | 434/211 |
| 4,343,471 A | | 8/1982 | Calvert | |
| 4,678,192 A | | 7/1987 | Campbell | 273/157 R |
| 4,804,187 A | | 2/1989 | Cramer | 273/157 R |
| 5,000,713 A | * | 3/1991 | Cheng | 273/160 |
| 5,009,625 A | * | 4/1991 | Longuet-Higgins | 446/92 |
| 5,098,328 A | | 3/1992 | Beerens | 446/128 |
| 5,127,652 A | | 7/1992 | Unger | 273/157 R |
| 5,411,262 A | | 5/1995 | Smith | 273/157 R |
| 5,481,841 A | | 1/1996 | Osborn | 52/311.2 |
| 5,580,056 A | | 12/1996 | Clark | 273/157 R |

FOREIGN PATENT DOCUMENTS

| | | |
|---|---|---|
| DE | 2307241 | 8/1974 |

* cited by examiner

*Primary Examiner*—Steven Wong
(74) *Attorney, Agent, or Firm*—The Bilicki Law Firm, P.C.

(57) ABSTRACT

This invention describes a puzzle comprising at least one fundamental unit. The fundamental unit comprises a cube with six faces. Each of the faces has two raised quadrants on diagonally opposite quadrants and two open quadrants on diagonally opposite quadrants. Each raised quadrant houses a bonding member. Each open quadrant houses a bonding member that will mate with and interlock with the bonding member of the raised quadrants such that the bonding member will hold a fundamental unit to another fundamental unit.

This invention describes a magnetic puzzle comprising at least one fundamental unit. The fundamental unit comprises a cube with six faces and a center. Each of the faces has two raised quadrants on diagonally opposite quadrants and two open quadrants wherein the face of the cube is exposed. Each quadrant houses a recessed magnet having a south and north pole. The magnets in the raised squares are oriented so that the north pole of the magnet is facing in a direction away from the center of the cube. The magnets in the open quadrants are oriented so that the south pole of the magnet is facing in a direction away from the center of the cube.

15 Claims, 10 Drawing Sheets

PUZZLE

CLAIM OF PRIORITY

This application claims priority to U.S. Provisional Patent Application, Serial No. 60/167,570, filed Nov. 26, 1999.

FIELD OF THE INVENTION

This invention relates generally to educational tools. The invention specifically relates to educational tools that also function as toys. The invention also generally relates to puzzles.

BACKGROUND OF THE INVENTION

Puzzles have been used to challenge the intellect for many centuries. As our awareness of the world surrounding us has grown over the decades, so too has the sophistication of the puzzles that challenge our intellect. There are many puzzles that have been patented by inventors. Indeed, many puzzles have been used both as building blocks but also as educational tools for young persons. Such puzzles are shown in patents, but also in the general public's consciousness. A few examples are the puzzles known as the Rubik's Cube® or the Lego® building system. Each of these puzzles has challenged the intellect as well as taught the user about physical qualities of the puzzle and the world surrounding the user.

The subject invention elevates the art of puzzles to a different level with its ability to challenge a person's intellect in achieving various spatial solutions. The subject invention also assists persons in understanding of the relationships between zero, one, two, three, and four-dimensional space. The subject invention is useful not only as an educational tool for young persons, but for adults as well.

SUMMARY OF THE INVENTION

This invention describes a puzzle comprising at least eight fundamental units. Each fundamental unit has the fundamental shape of a cube with six faces. Each of the faces has two raised quadrants on diagonally opposite quadrants and two flat quadrants on the other diagonally opposite quadrants. Each raised quadrant houses a bonding element. Each flat quadrant houses a bonding element that will mate with and interlock with the bonding element of the raised quadrants such that the bonding element will hold one fundamental unit to another fundamental unit.

This invention describes a magnetic puzzle comprising at least one fundamental unit. The fundamental unit comprises a cube with six faces, eight corners, and a center. Each of the faces has two raised quadrants on diagonally opposite quadrants and two open quadrants wherein the face of the cube is exposed. The raised and open quadrants are arranged such that that each corner of a first set of diagonally opposite corners are compromised of two raised quadrants and one open quadrant, while each corner of a second set of diagonally opposite corners is comprised of one raised and two open quadrants. Each quadrant houses a recessed magnet having a south and north pole. The magnets in the raised squares are oriented so that the north pole of the magnet is facing in a direction away from the center of the cube. The magnets in the open quadrant are oriented so that the south pole of the magnet is facing in a direction away from the center of the cube.

It is an object of the subject invention to provide a puzzle with non-trivial solutions in, at least, zero, one, two, three and four dimensions.

It is additionally an object of the subject invention to provide an educational tool for users to learn about and visualize the fourth dimension.

It is further an object of the subject invention to provide an educational tool for applications such as envisioning the operation of gears.

It is an additional object of the subject invention to provide an educational tool for applications such as envisioning crystal lattice stacking.

It is an additional object of the subject invention to provide an educational tool for applications such as encoding of data with geometric shape and color.

It is an additional object of the subject invention to provide an educational tool for applications such as envisioning the chemical bonding of molecules.

It is a further object of the subject invention to provide a system with bonding attributes of paired elements that can be used as an educational tool to understand the spatial attributes and information storage capability of other paired elements in nature such as DNA and/or RNA.

DETAILED DESCRIPTION OF THE PREFERRED EMBODIMENT

Figure 1:
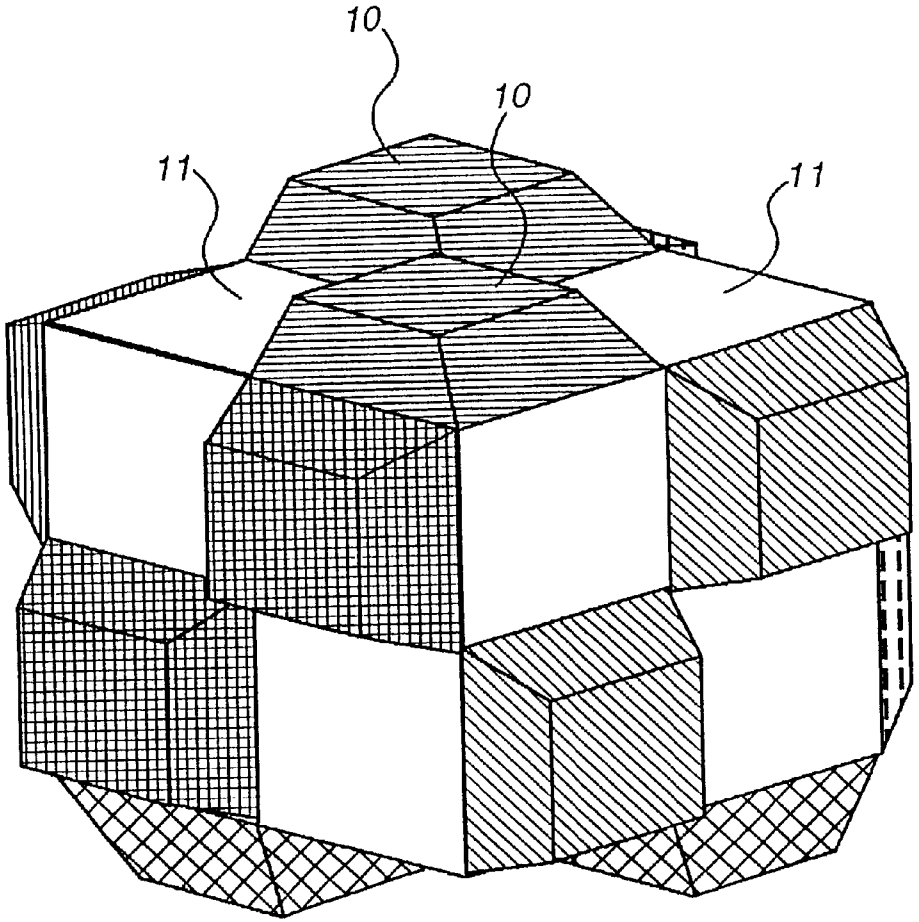
FIG. 1 is a three-dimensional view of a fundamental unit of the subject invention
Figure 2:
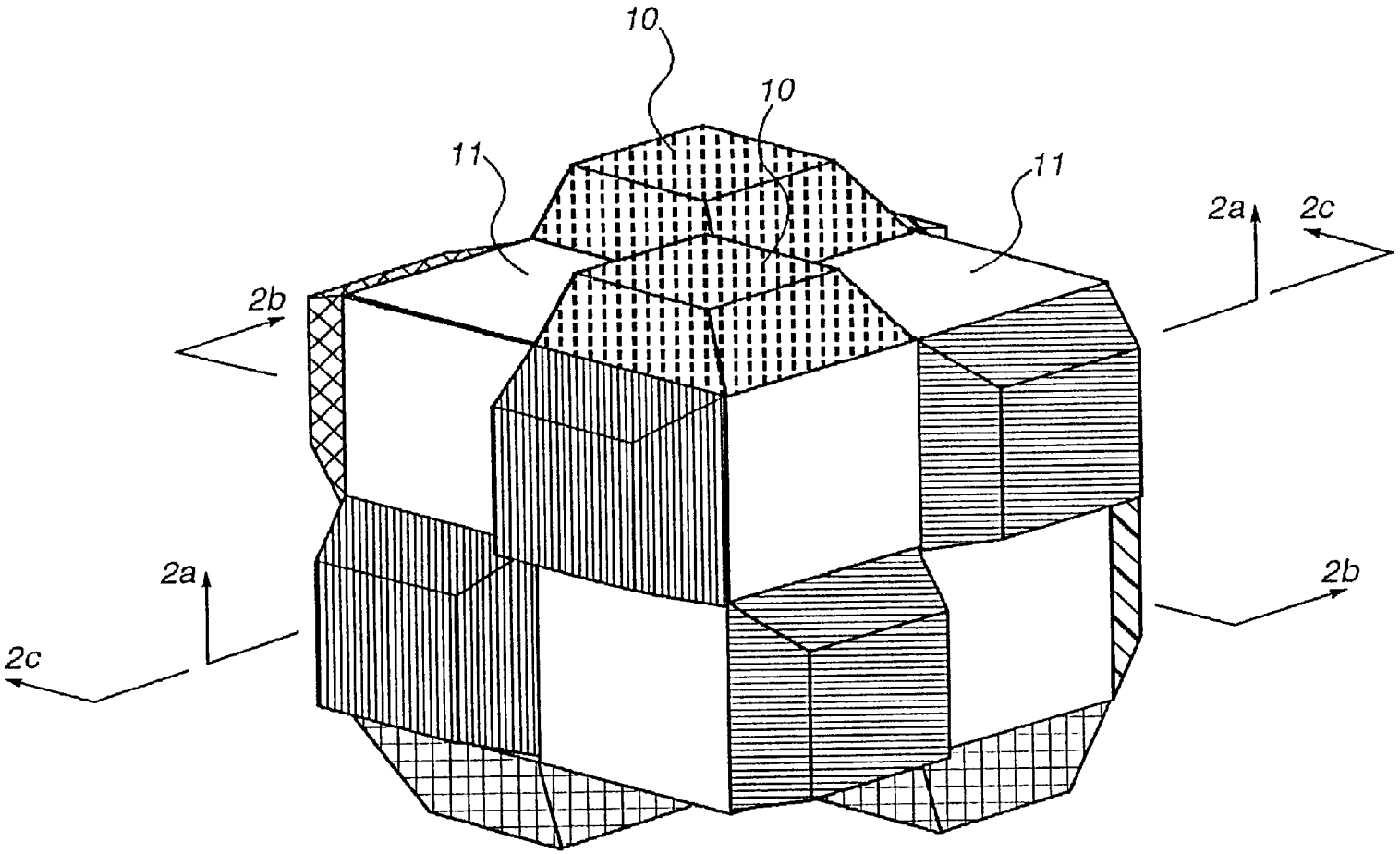
FIGS. 2A, 2B, and 2C are cut-away sectional views of a fundamental unit of the subject invention along the x-y axis, the z-y axis, and the z-x axis, respectively.

Referring now to the drawings in detail, for the ease of the reader, like reference numerals designate identical or corresponding parts throughout the views depicted in the drawings. It should be noted that each embodiment is not depicted by a drawing nor are each of the notable applications depicted by a drawing. The invention is comprised of at least one fundamental unit as shown in FIG. 1. In the most preferred embodiment, the number of fundamental units provided is eight, although the number of fundamental units can be any number greater than two. Each fundamental unit is shaped like a cube and possesses six faces as shown in FIG. 1. Each face is divided into four equal quadrants. Each quadrant of the cube houses a recessed magnet 20 as shown in FIG. 2. Each magnet has a north pole and a south pole. Two of the quadrants 10 are raised to an elevational above the baseline of the face of the cube FIG. 1. Each raised quadrant of the cube houses the recessed magnet oriented with the north pole of the magnet facing away from the center of the fundamental unit 20. The shape of each raised quadrant resembles a frustum (or truncated pyramid) 10. The raised quadrants are arranged on the face diagonally opposite one another FIG. 1.

The non-raised quadrants house the recessed magnets 21 oriented with the south pole of the magnet facing away from the center of the fundamental unit. The magnetic attraction between the recessed magnets is used to hold the fundamental units together and interlock the units to form various solutions as shown in FIGS. 4, 5, 6, and 7. The diagonally opposite raised and open quadrants of the cube are arranged such that a first set of diagonally opposite corners are comprised of two raised quadrants and one open quadrant, while a second set of diagonally opposite corners are comprised of two open and one raised quadrant. Diagonally opposite comers are defined as the comers comprising each face of the cube that are diagonally opposite from each other. The shape and positioning of the raised quadrants restrict some orientations of connected cubes, thus providing some difficulty in achieving the solutions described hereinbelow. The shape and positioning of the raised quadrants also acts as teeth on geared wheels when the puzzle is manipulated.

In the preferred embodiment, a scheme of six colors, comprising three primary colors and their complements (for a total of six different colors) will be used to assign each face of a fundamental unit a different color as depicted in FIGS. 3A through 3D. To contrast between the open and the raised quadrants, in one embodiment, the open quadrants would be black while the other raised quadrants would be colored. The color scheme will be divided into three pairs such that the primary color on one face of the unit will have a paired complementary color on the opposite face. Such a scheme would be red paired with green, blue paired with orange and yellow paired with purple. Thus, for all fundamental units of a certain puzzle, the colors red and green will always be on opposite faces. With this pairing of colors, in a puzzle with eight fundamental units, there will be four different pairs of identically colored units as shown in FIGS. 3A, 3B, 3C, and 3D. Although color enlivens the invention and provides distinctive markings, it is obvious to one skilled in the art the specific coloring of the raised quadrants described herein is not necessary for the invention to operate properly. However, the placement of the colors can assist the user in solving the puzzle according to one of the below-described solutions. It is also obvious to one skilled in the art that, in place of a coloring scheme, any number of textual variations could be employed for use by those with impaired vision to provide the same representations as the colors do for those with sufficient vision to see the colors. In addition, one skilled in the art will also recognize that, in place of the coloring scheme, any number of sounds or small shocks could be employed to provide the same representations that the coloring scheme provides.

It is also obvious to one skilled in the art that any number of bonding elements, whether electromagnetic, mechanical or chemical, can be utilized to interlock the fundamental units. In addition, it is obvious to one skilled in the art that the fundamental units described herein can be constructed out of any material. It can be readily appreciated from the instant specification that this puzzle can be embodied in a computer program to allow a user to manipulate the fundamental units within a computer game or software program used as an educational tool.

Figure 2A:
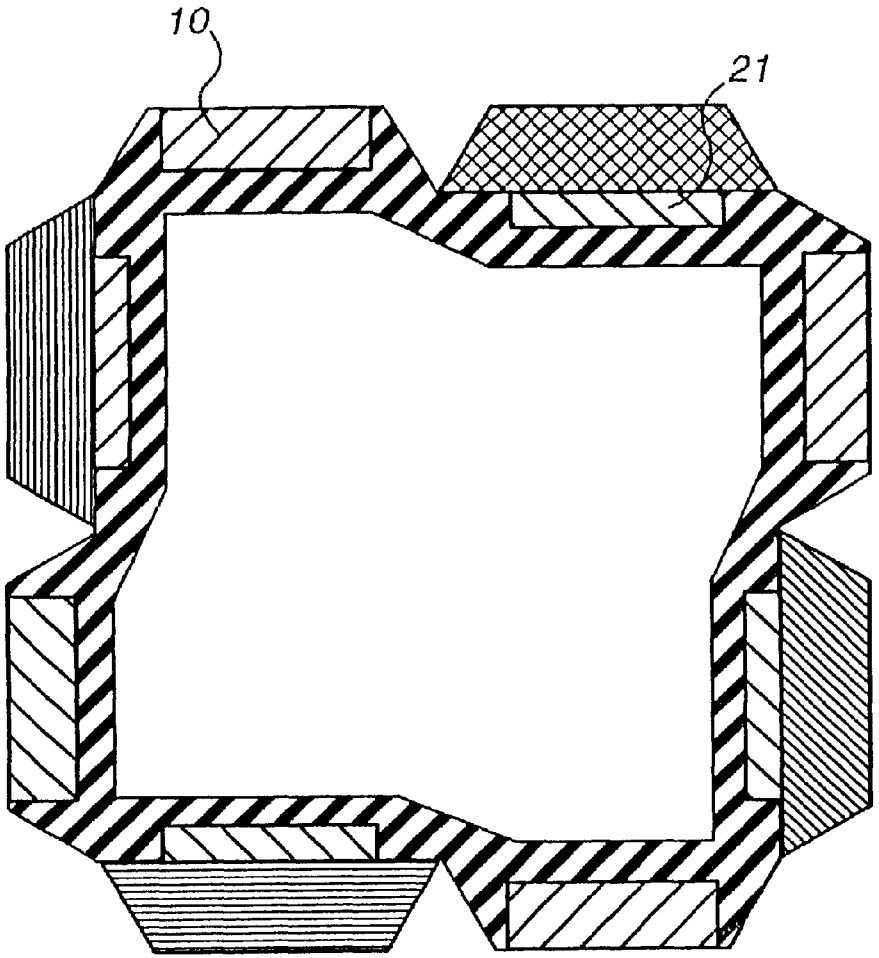
Figure 2B:
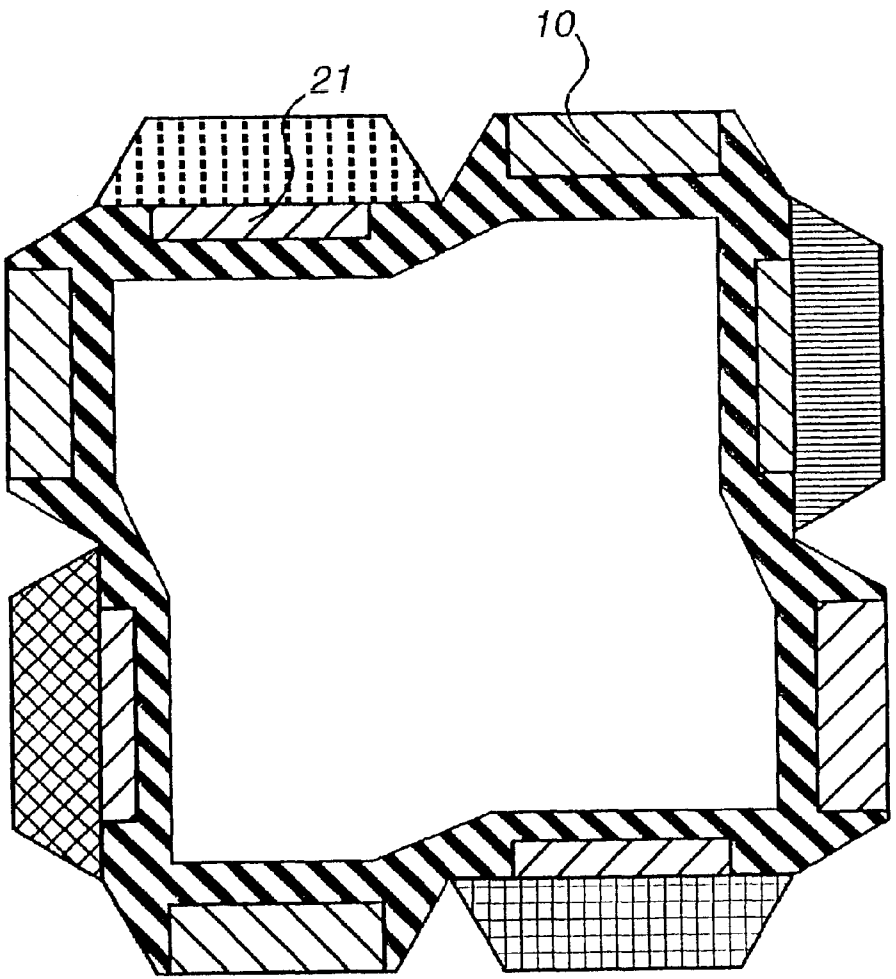
Figure 2C:
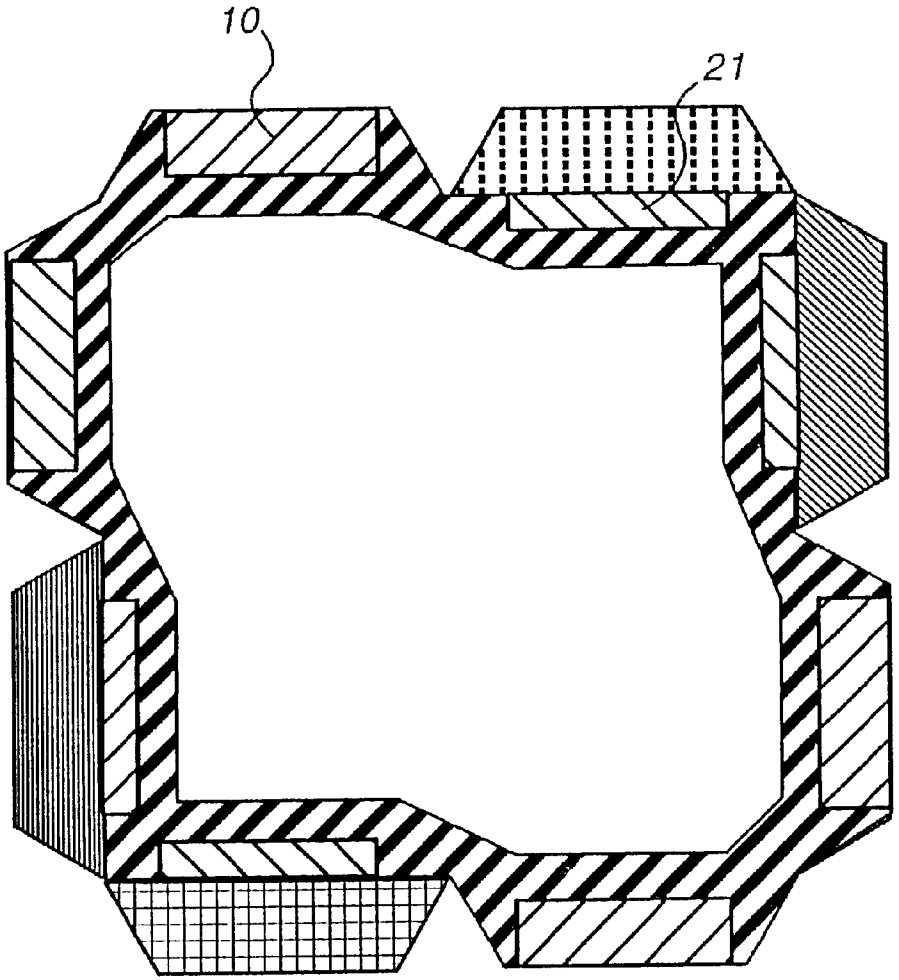
Figure 3B:
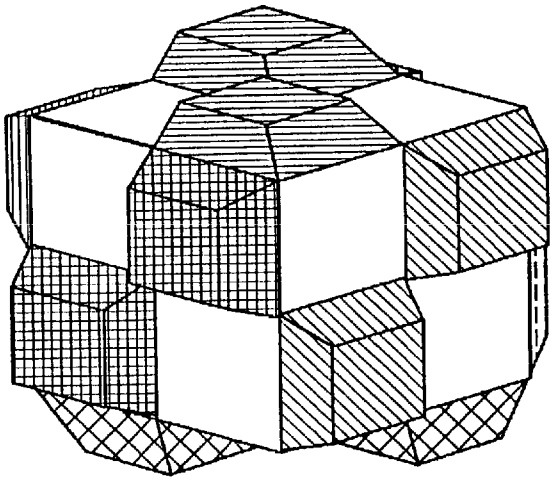
FIGS. 3A, 3B, 3C, and 3D are three-dimensional views showing the colors of four fundamental units in the most preferred embodiment. A pair of each of the four fundamental units depicted in FIGS. 3A through 3D is provided as the most preferred embodiment of the subject invention.
Figure 3D:
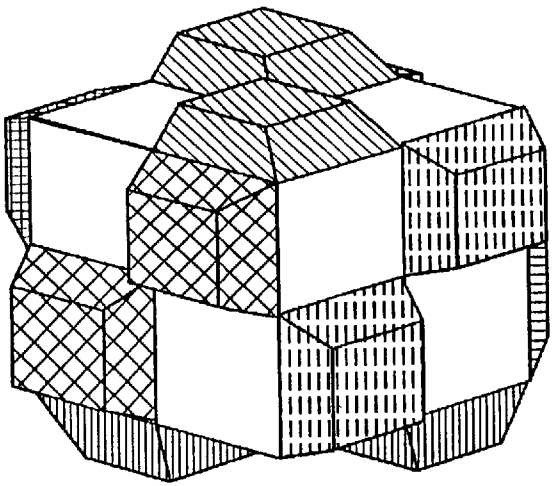
Figure 3A:
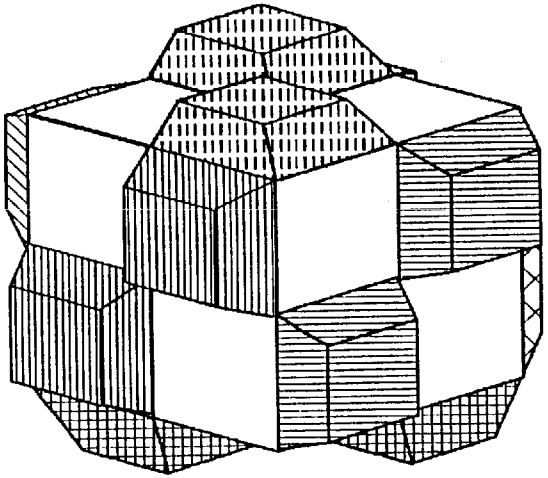
Figure 3C:
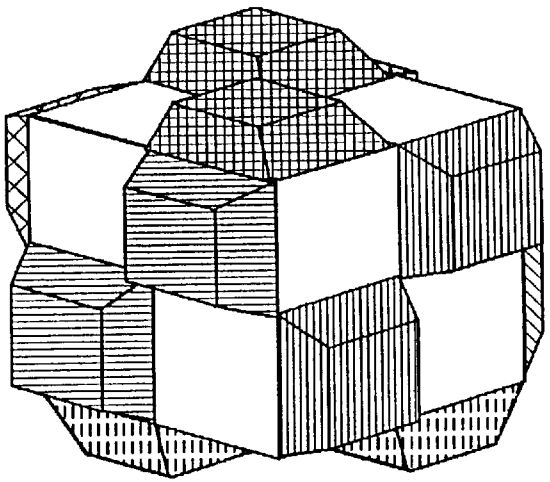

Each of the eight fundamental units will have the same specific arrangement of raised quadrants. This symmetry of arrangement allows the raised quadrants on two axes of the unit will be identical and the third axis the raised quadrant will be inverted as shown clearly in FIGS. 2A through 2C. The fundamental unit is thus asymmetrical about and around its three axes. The asymmetry of the fundamental unit and the applied color scheme prevents the solutions to this puzzle from becoming pedestrian.

Solutions to the Puzzle

Zero-dimensional—The fundamental units are separated and placed apart from each other. One fundamental unit is chosen and the user must locate the other fundamental unit(s) that match. This selection and matching is continued until all of the fundamental units have a match.

Figure 4:
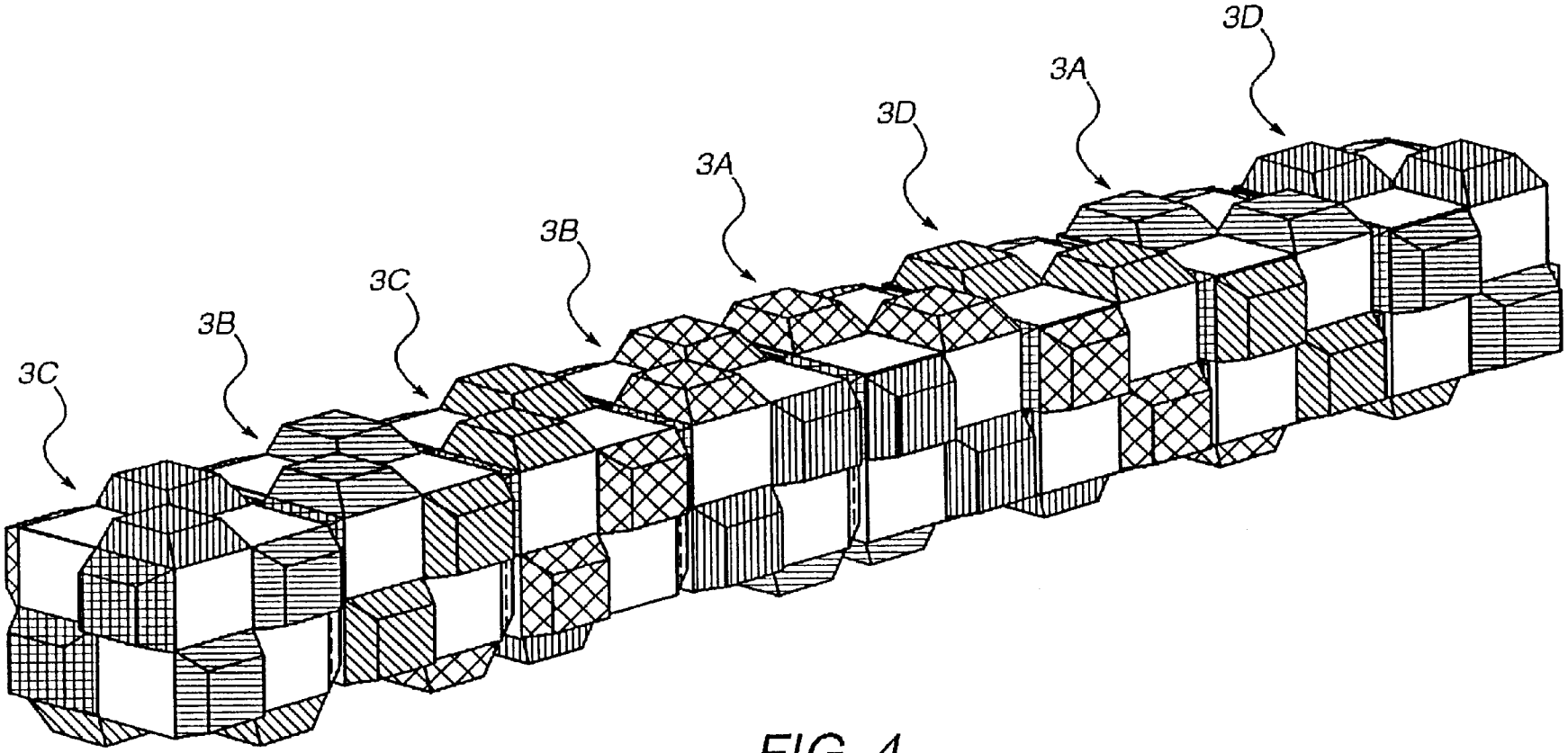
FIG. 4 is a depiction of the one-dimensional solution described herein.

One-dimensional—The fundamental units of the invention are placed in a line such that the magnets on adjoining faces match north and south polarities and each unit is interlocked with another unit. An added task is to arrange the colors so that a primary color of each unit faces in the same direction along the line of units. The colors on the side faces of the units twist around the assembled line as the stripes on a barber pole. This solution is depicted in FIG. 4.

Figure 5:
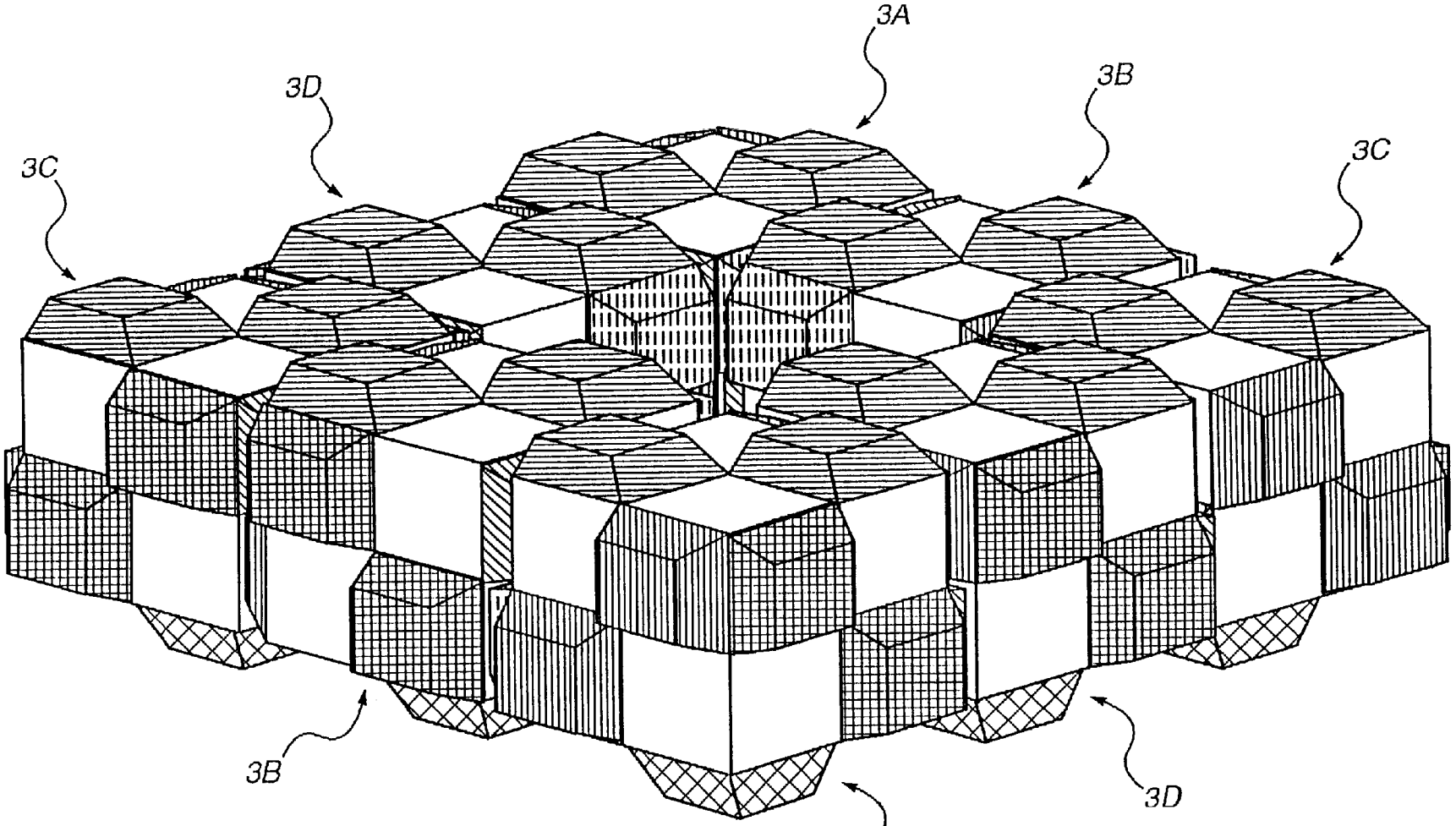
FIG. 5 is a depiction of the two-dimensional solution described herein.

Two-dimensional—The fundamental units of the invention are placed in an array that is three units deep by three units long by 1 unit high, such that the units, when joined, form a square with a unit-sized hole in the middle. This solution is more difficult than the one-dimensional solution since each unit must be matched to two neighboring units whose faces must be appropriately oriented in order for the magnets and teeth of each of the units to interlock. This solution is depicted in FIG. 5.

Figure 6:
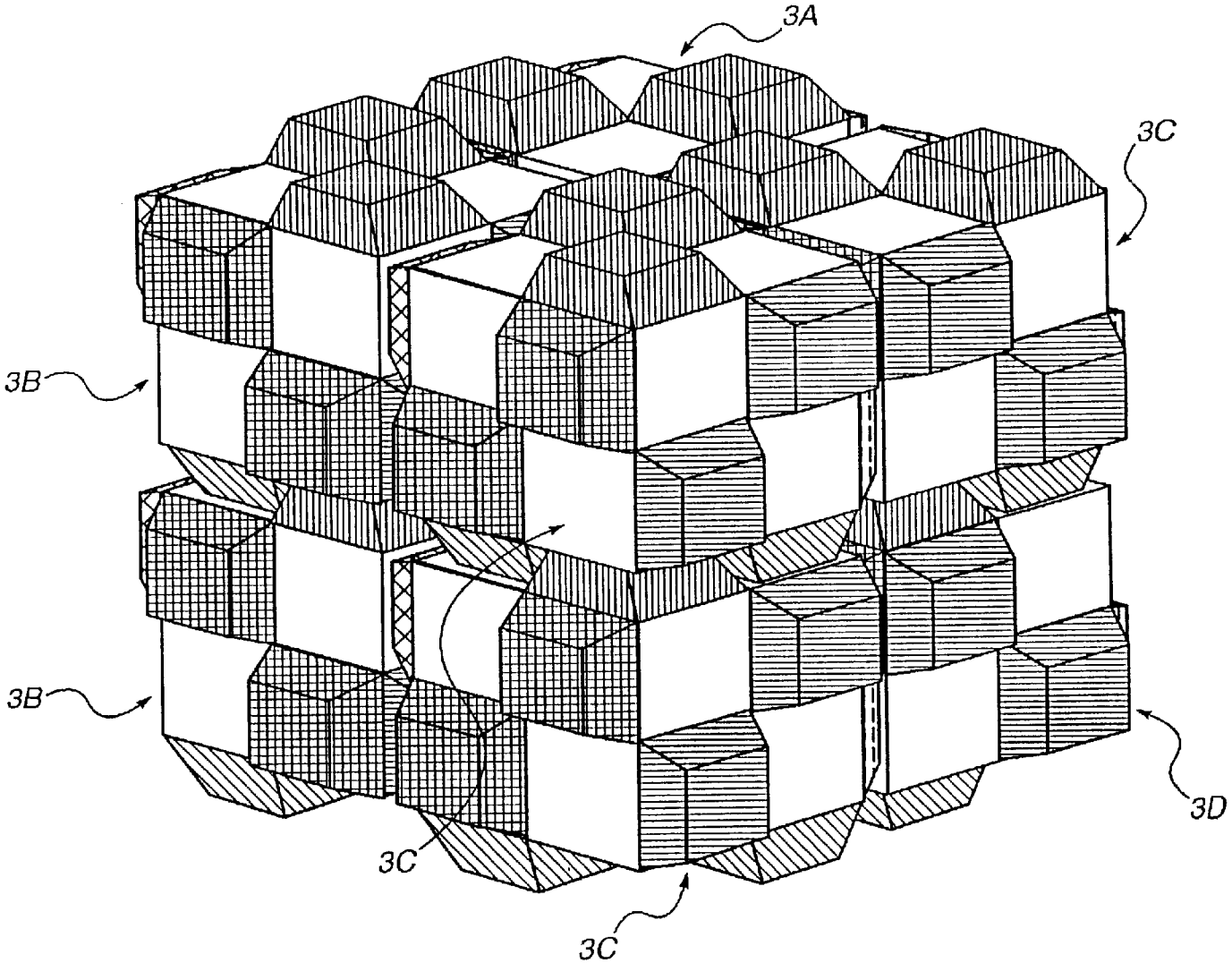
FIG. 6 is a depiction of the three-dimensional solution described herein.

Three-dimensional—The fundamental units of the invention are placed in a two unit deep to by two unit long by two unit high array. This solution is a cube. An added task is to arrange the fundamental units in a cube such that each face of the assembled cube displays only one of six colors. This solution is more difficult than the one or two-dimensional solutions since each unit must be matched to three neighboring units whose faces must be appropriately oriented in order for the magnets and teeth of each of the units to interlock. This solution is depicted in FIG. 6.

Figure 7:
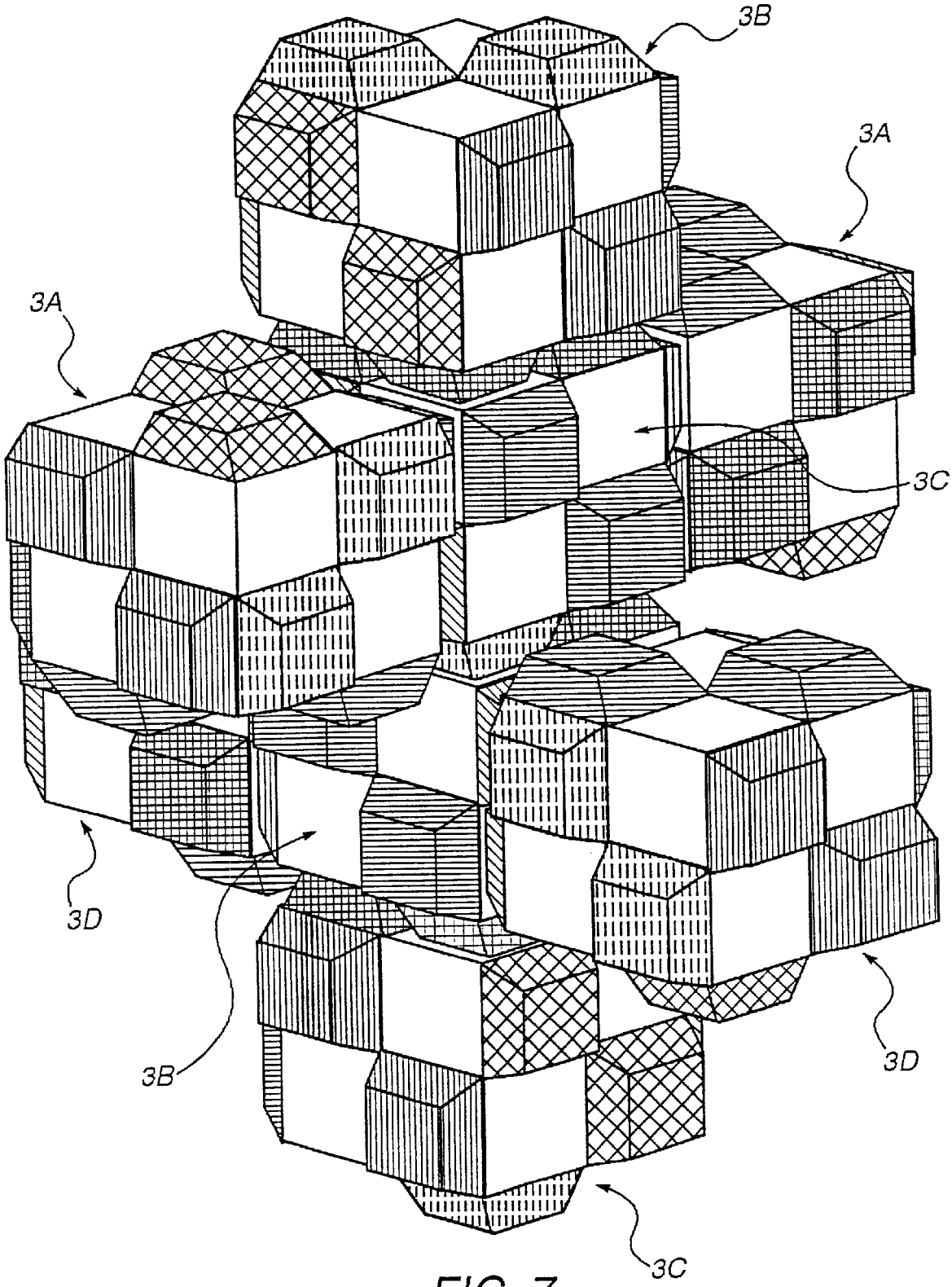
FIG. 7 is a depiction of the four-dimensional solution described herein.

Four-dimensional—The fundamental units of the invention are placed in a shape that is termed a tesseract. A tesseract is a commonly understood mathematical model of an unfolded four dimensional hypercube. A tesseract is comprised of eight cubes that make up the face volumes of the unfolded hypercube. The shape of a tesseract is analogous to the cross shape of a sheet of cardboard before it is folded into a cardboard box. One way to attain the tesseract solution is to arrange a row of four fundamental units so as to interlock the units. Surrounding and interlocking with one of these fundamental units are four other fundamental units. The resulting tesseract resembles a cross, no matter which way the solution is viewed. In the tesseract solution any unit must be able to be disengaged from an interlocking partner and rotated through 90 degrees to meet and interlock with the face of a neighboring unit. This solution is even more difficult to achieve since each unit must relate properly to six potential neighbors. An added task is to place all the units so that each colored face touches the same color on any adjoining partner. This color joining rule must apply when any unit is swung through 90 degrees to interlock with any potential neighboring unit. If this resulting tesseract were folded into a four dimensional cube, the eight fundamental units (comprising the surface of the hypercube) would be arranged so that moving from the three-dimensional volume of any unit, through one of its six colored faces would result in entering the adjoining three-dimensional volume through the same colored face. A variation of this solution is depicted in FIG. 7.

While each of the solutions described above depict an "ordered" solution to the puzzle, it is obvious to one skilled in the art that many other "solutions" are available to a user and the solutions are limited only to the user's imagination.

Although, for convenience, the method and apparatus of the present invention have been as described hereinabove primarily with respect to the use of the present invention as a toy as well as a few other applications, it will be apparent to those skilled in the art that the invention can be used to teach others about the fourth dimension as well as the invention's use as an educational tool in other fields of science, such as genetic engineering.

What is claimed is:

1. A puzzle comprising:

at least one fundamental unit;

said fundamental unit comprising a cube with six faces and having a center;

said faces having two raised quadrants on diagonally opposite quadrants and two open quadrants on diagonally opposite quadrants;

a first set of diagonally opposite corners wherein each one of said first set of diagonally opposite corners comprises two raised quadrants and one open quadrant;

a second set of diagonally opposite corners wherein each one of said second set of diagonally opposite corners comprises one raised quadrant and two open quadrants;

a bonding element located in each said raised and said open quadrants of the fundamental units; and, said bonding element in said raised quadrant operatively arranged to mate with said bonding element in said open quadrant.

2. A puzzle according to claim 1 wherein said bonding element in each said raised and open quadrants comprises a magnet; said magnet having a north pole and a south pole.

3. A puzzle according to claim 2 wherein:

said magnet in said raised quadrant is oriented with said north pole facing away from the center of the fundamental unit; and, said magnet in said open quadrant is oriented with said south pole facing away from the center of the fundamental unit.

4. A puzzle according to claim 1 wherein the raised quadrants of each face are the same color such that six different colors are used for the fundamental unit, wherein said six colors are used to form solutions to said puzzle, said solutions increasing in degree of difficulty with the number of colors forming said solutions.

5. A puzzle according to claim 4 wherein the open quadrants of each face are black in color.

6. A puzzle according to claim 5 further comprising:

at least eight fundamental units wherein each fundamental unit interlocks with at one other fundamental unit.

7. A puzzle according to claim 6 wherein the puzzle is embodied in a computer program.

8. A puzzle according to claim 6 wherein a solution in zero-dimension for the puzzle comprises matching at least two fundamental units.

9. A puzzle according to claim 6 wherein a solution in one-dimension for the puzzle comprises a line of the fundamental units interlocked together.

10. A puzzle according to claim 9 wherein an alternative solution in one-dimension for the puzzle comprises an arrangement of the fundamental units such that the color of each face are oriented in a same direction.

11. A puzzle according to claim 6 wherein a solution in two-dimensions for the puzzle comprises an array of fundamental units that is three units long by three units deep by one unit high, such that the solution forms a square.

12. A puzzle according to claim 6 wherein a solution in three-dimensions for the puzzle comprises a cube.

13. A puzzle according to claim 12 wherein the solution further comprises arranging the colors of the fundamental units such that the raised quadrants on each side of the cube show only one color.

14. A puzzle according to claim 6 wherein a solution in four-dimensions for the puzzle comprises a tesseract.

15. A puzzle according to claim 14 wherein the solution can further comprise arranging the color of the faces of the fundamental units in the tesseract such that the color of one face touches the same color on any adjoining face of a fundamental unit.

* * * * *